US010553936B2

(12) United States Patent
Jue

(10) Patent No.: US 10,553,936 B2
(45) Date of Patent: Feb. 4, 2020

(54) ANTENNA TUNING CIRCUITS, MODULES, AND SYSTEMS AND RELATED TECHNIQUES

(71) Applicant: Martin F. Jue, Starkville, MS (US)

(72) Inventor: Martin F. Jue, Starkville, MS (US)

( * ) Notice: Subject to any disclaimer, the term of this patent is extended or adjusted under 35 U.S.C. 154(b) by 0 days.

(21) Appl. No.: 16/454,504

(22) Filed: Jun. 27, 2019

(65) Prior Publication Data

US 2019/0319344 A1 Oct. 17, 2019

Related U.S. Application Data

(63) Continuation-in-part of application No. 16/211,876, filed on Dec. 6, 2018, now Pat. No. 10,340,586, which is a continuation of application No. 15/408,066, filed on Jan. 17, 2017, now Pat. No. 10,153,541.

(51) Int. Cl.

| | |
|---|---|
| ***H01Q 1/24*** | (2006.01) |
| ***H01Q 1/32*** | (2006.01) |
| ***H01Q 5/335*** | (2015.01) |
| ***H01Q 1/38*** | (2006.01) |
| ***H01Q 9/30*** | (2006.01) |

(52) U.S. Cl.

CPC ..... *H01Q 1/3208* (2013.01); *H01Q 1/24* (2013.01); *H01Q 1/3283* (2013.01); *H01Q 1/38* (2013.01); *H01Q 5/335* (2015.01); *H01Q 9/30* (2013.01)

(58) Field of Classification Search

CPC .. H01Q 1/32; H01Q 5/33; H01Q 1/24; H01Q 1/38; H01Q 9/30

USPC ..... 343/713

See application file for complete search history.

(56) References Cited

U.S. PATENT DOCUMENTS 6,008,768 A * 12/1999 Wilson ..... H01Q 1/3275 343/713

8,810,466 B2 * 8/2014 Scire-Scappuzzo ..... H01Q 9/28 343/705

* cited by examiner

*Primary Examiner* — Andrea Lindgren Baltzell

(74) *Attorney, Agent, or Firm* — Hayes Soloway PC

(57) ABSTRACT

In accordance with some embodiments, an automatically tunable mobile antenna is provided with toroidal inductors connected in series between the antenna feed point and a whip and a shunt inductor to ground at the RF input, with the inductors forming an L network impedance matching circuit having values which are in a binary sequence and which are selectively added to impedance match the whip to the output impedance of a transmitter. In accordance with some embodiments, an automatically tunable mobile antenna is provided with a variable toroidal inductor assembly connected between the antenna feed point and the whip having a variable inductance based on selective shorting and unshorting of wire windings to impedance match the whip to the output impedance of the transmitter.

20 Claims, 10 Drawing Sheets

ANTENNA TUNING CIRCUITS, MODULES, AND SYSTEMS AND RELATED TECHNIQUES

CROSS-REFERENCE TO RELATED APPLICATIONS

This patent application is a Continuation-in-Part of U.S. patent application Ser. No. 16/211,876, filed on Dec. 6, 2018, which is a Continuation of U.S. patent application Ser. No. 15/408,066, filed on Jan. 17, 2017, each of which is herein incorporated by reference in its entirety.

FIELD OF THE DISCLOSURE

This invention relates to antennas (mobile or otherwise) and, more particularly, to an automatically tunable mobile antenna having inductors connected in series at the base of a whip having values which are in a binary sequence and which are selectively shorted or un-shorted to impedance match the whip to the output impedance of a transmitter and/or a variable toroidal inductor assembly at the base of the whip having a variable inductance based on selective shorting and un-shorting of wire windings to impedance match the whip to the output impedance of the transmitter.

BACKGROUND

Mobile high-frequency (or HF) 3-30 mHz antennas have, in general, been short for the frequency of operation. Because they are short, the antenna's loading coils are used to cancel out the capacitive reactance associated with short antennas, normally whip antennas. The loading coil can be placed at the base of a whip or can be put in the center of the whip, which is usually somewhere between 6 and 10 feet long. One can also put the loading coil at the top of the whip with a capacitive top load. While this top-loaded configuration works, the antenna can be made to operate effectively by bottom-loading the whip because it takes less inductance.

In the past, mobile antennas have been singled-banded, meaning they operate in one frequency range. These antennas can be made multi-banded by changing the frequency and tapping the coil used to load the antenna and shorting out the remainder of the coil. In a fairly recent innovation in the past 20 years, so-called screwdriver antennas have been developed, which are basically a center-loaded antenna having a variable turn coil. It will be noted that, in these configurations, the coil is fairly large in both length and diameter and usually has a cover that goes from the bottom of the coil to the top. The cover and internal shorting circuitry are motor-driven to move to short out portions of the coil as it is extended or contracted such that portions of the coil are shorted except the part of the coil that is used for the matching.

Typically, in such coils, the movable tap is driven by a DC motor with the motor being stopped at the point when the standing wave ratio (or SWR) is at a minimum. However, in order to change bands with such an antenna, the amount of time utilized in driving the motor is excessive such that to go from one band to another may take as many as 3 minutes. This is inconvenient when one wishes to shift from one band to another. It is likewise inconvenient when, within a band, one significantly tunes off the frequency at which the coil was originally set. Moreover, in the past for non-automatic screwdriver antennas, the coil is set by hand, which, for instance, requires the driver to get out of the car and move the tap.

In order to solve the inconvenience described above, there have been attempts to locate an antenna tuner at the base of the whip to effectuate impedance matching. However, antenna tuners are far less efficient than the use of a loading coil because of the stray capacitance at the output of the tuner. The capacitance and radiation resistance of the antenna is what is being fed by radio frequency (RF) energy. This stray capacitance is in parallel with the capacitance associated with the antenna itself. Thus, when one applies RF current to the antenna, the current is divided between the antenna and the stray capacitance. Note that the current created in the antenna causes radio waves to radiate. The more current that one can get into the antenna whip, the more it will radiate and the better it will perform. However, if more current is going into stray capacitance, then the amount of radiated power is diminished. While the tuner itself may include loading coils, it is nonetheless important to minimize stray capacitance by locating the loading coils on the antenna whip itself where the loading coil is not touching anything except the whip. This minimizes stray capacitance and provides a far better power transfer to the antenna. In antenna tuners, any loading coils are located within the antenna tuner itself.

Thus, the use of antenna tuners at the base of a whip has been largely rejected, and automatic screwdriver antennas have been substituted for the use of these antenna tuners. However, these automatic screwdriver antenna tuners are expensive and require either a manual or an expensive controller. Due to the external coil and the tapping arrangement, these antennas are big and heavy and are extremely costly. Moreover, they are unsightly if one is attempting to get a big efficient antenna. The small ones are better looking but do not work as well because of the Q factor of the coil. It is noted that one can hardly obtain an unloaded Q factor better than 500 to 600 out of any free-standing coil, and this requires relatively large size coils. Moreover, large coils with such a high Q factor limit the effective usable bandwidth of the antenna once it is tuned. Thus, there is a requirement for efficient mobile antennas to provide a high Q factor coil without being unsightly, large, and expensive.

There is, however, a base-loaded tunable mobile antenna produced by the Barrett Corporation of Australia, which utilizes a series of air-wound loading coils in a housing which are connected together to form the impedance matching function. The system requires a specialized transformer between the lower of the coils and the antenna feed point to transform the antenna impedance into one that matches the output of a transceiver, usually around 50 ohms. However, it is only with difficulty that these antennas can be made to match the transceiver output impedance. It is noted that, when the impedance matching offered exceeds a 2:1 SWR ratio, there is a folding back of the transmit power so that the antenna presents an SWR less than 2:1 SWR to the particular radio to which it is coupled. This requires specialized transformers that are designed for a particular transceiver. However, in terms of general-purpose amateur radios, absent a perfect match, these radios fold back the power so that these antennas do not always work particularly well.

Moreover, the Barrett antenna utilizes air-wound coils which, when placed in proximity to each other, crosstalk with each other such that the ability to effectuate a perfect match between the whip and the transceiver is impacted at various frequencies, making the matching unstable. In an effort to reduce crosstalk, the air-wound coils are oriented at right angles to each other. However, this technique only marginally reduces crosstalk.

Furthermore, if the relationship of the inductance values of each of the coils is not binary related, it makes switching schemes to switch these coils in and out an ad hoc process.

Finally, in the Barrett antennas, switching software is located at the base of the antenna where RF fields are high and oftentimes interfere with the semiconductor switching circuits located at the base of the whip. Housing the electronics for switching the coils of the Barrett antenna at the base of the whip, thus, presents instability problems, especially for the high currents involved when driving a whip-like antenna.

There is, therefore, a need for an automatic antenna tuning system for mobile whip antennas to eliminate the aforementioned problems.

SUMMARY

In the subject invention, a number of series-connected toroidal coils are connected between the antenna feed point and a whip, with the inductance values of the toroidal coils being in a binary sequence such that, for instance, the inductance values of the coils might be, for instance, 2 micro-henrys, 4 micro-henrys, 8 micro-henrys, 16 micro-henrys, etc. Note that toroidal inductors are utilized due to the fact that the RF energy is contained within the toroid itself. Relays are placed across the various toroidal coils to un-short the coils in accordance with the output of a controller, which is located remote from the antenna and usually at the transceiver located within a vehicle. The granularity of the inductance values is determined by the coil having the least inductance. Moreover, a shunt coil is located between the antenna feed point and ground to effectuate impedance matching to the normal 50-ohm output of a transceiver.

In one embodiment, a fiberglass rod is located within a generally cylindrical housing which supports a whip connector at the top of the housing and runs down to the bottom of the housing at which point a ⅜×24 threaded stud connector is located. The switching circuit is located within a housing that mounts normally closed relays. These relays are mounted on a circuit board running vertically and attached to the fiberglass rod within the housing. The control head, in one embodiment, includes a rotary encoder switch connected to the relays to control the switching state associated with the relays to un-short the associated coils until such time as a minimum SWR is indicated by a meter on the control head or on the transceiver. When a minimum SWR is achieved for a given frequency, this is memorized by circuits within the control head such that in returning to the frequency, the particular relays which optimize the SWR for the frequency are opened. In an alternative embodiment, the frequency from the transceiver utilized to drive the mobile antenna is detected, and the relays are set in accordance with the previously memorized settings.

It will be appreciated that because of the use of a binary sequence, the inductance steps are linear and additive, such that for each increment in inductance, the next higher inductance is added to the lower inductance. This is accomplished with the un-shorting of the coils such that when each of the coils is un-shorted, the added inductance is cumulative, with the amount of inductance presented between the antenna feed point and the whip increasing in a linear stepped manner.

In the tuning procedure, the amount of inductance switched in starts at the lowest inductance and increases with the opening up of more relays. Thus, in one embodiment, the microprocessor-controlled relays sequence from a low inductance to high inductance such that more and more inductance comes out of the bottom section of the unit in the same manner as a screwdriver antenna uncovers increasing numbers of coils to add inductance for antenna tuning.

In summary, an automatically tunable mobile antenna is provided with toroidal inductors connected in series between the antenna feed point and a whip. The fixed shunt inductor along with the series inductors form an L network impedance matching circuit having values which are in a binary sequence and which are selectively added to impedance match the whip to the output impedance of a transmitter.

One example embodiment provides an antenna tuning device configured to be connected between a radio frequency (RF) signal source and an antenna. The antenna tuning device includes a toroidal inductor including a plurality of windings of electrically conductive wire. The antenna tuning device further includes a shaft extending through a center region of the toroidal inductor and configured to rotate within the center region of the toroidal inductor. The antenna tuning device further includes a movable contact arm connected to an end of the shaft, wherein by rotating the shaft within the center region of the toroidal inductor, the movable contact arm rotates so as to selectively electrically short at least one of the windings of wire contacted by the movable contact arm, thereby changing an inductance of the toroidal inductor.

In some cases, the toroidal inductor includes an air core. In some cases, the toroidal inductor includes at least one of a powder-iron core, a ferrite core, and a brass core.

In some cases, the toroidal inductor is of generally circular or elliptical cross-sectional geometry. In some cases, the toroidal inductor is of generally rectangular or square cross-sectional geometry.

In some cases, the electrically conductive wire includes at least one of copper (Cu), aluminum (Al), and silver (Ag).

In some cases, the movable contact arm is configured to contact only a single winding of wire at a time. In some cases, the movable contact arm is configured to contact a plurality of windings of wire at a time.

In some cases, the movable contact arm is an assembly of at least two bodies. In some cases, the movable contact arm is of single-piece construction.

In some cases, the shaft is configured to be rotated manually. In some cases, the shaft is configured to be rotated mechanically. In some cases, the shaft is configured to be rotated both manually and mechanically.

In some cases, the antenna tuning device further includes a motor connected to the shaft and configured to rotate the shaft within the center region of the toroidal inductor. In some instances, the motor includes at least one of a stepper motor, a DC motor, a gear-reduced motor with a position feedback potentiometer, and a servo motor. In some instances, the antenna tuning device further includes a power supply configured to provide power to the motor in rotating the shaft. In some instances, the antenna tuning device further includes a controller configured to control the motor in rotating the shaft.

In some cases, the RF signal source is a transmitter. In some cases, the antenna is a whip antenna.

In some cases, an antenna tuning module is provided, the antenna tuning module including the antenna tuning device and a housing configured to at least partially house the antenna tuning device.

BRIEF DESCRIPTION OF THE DRAWINGS

These and other features of the subject invention will be better understood in connection with the Detailed Description in conjunction with the Drawings of which.

DETAILED DESCRIPTION

Figure 1:
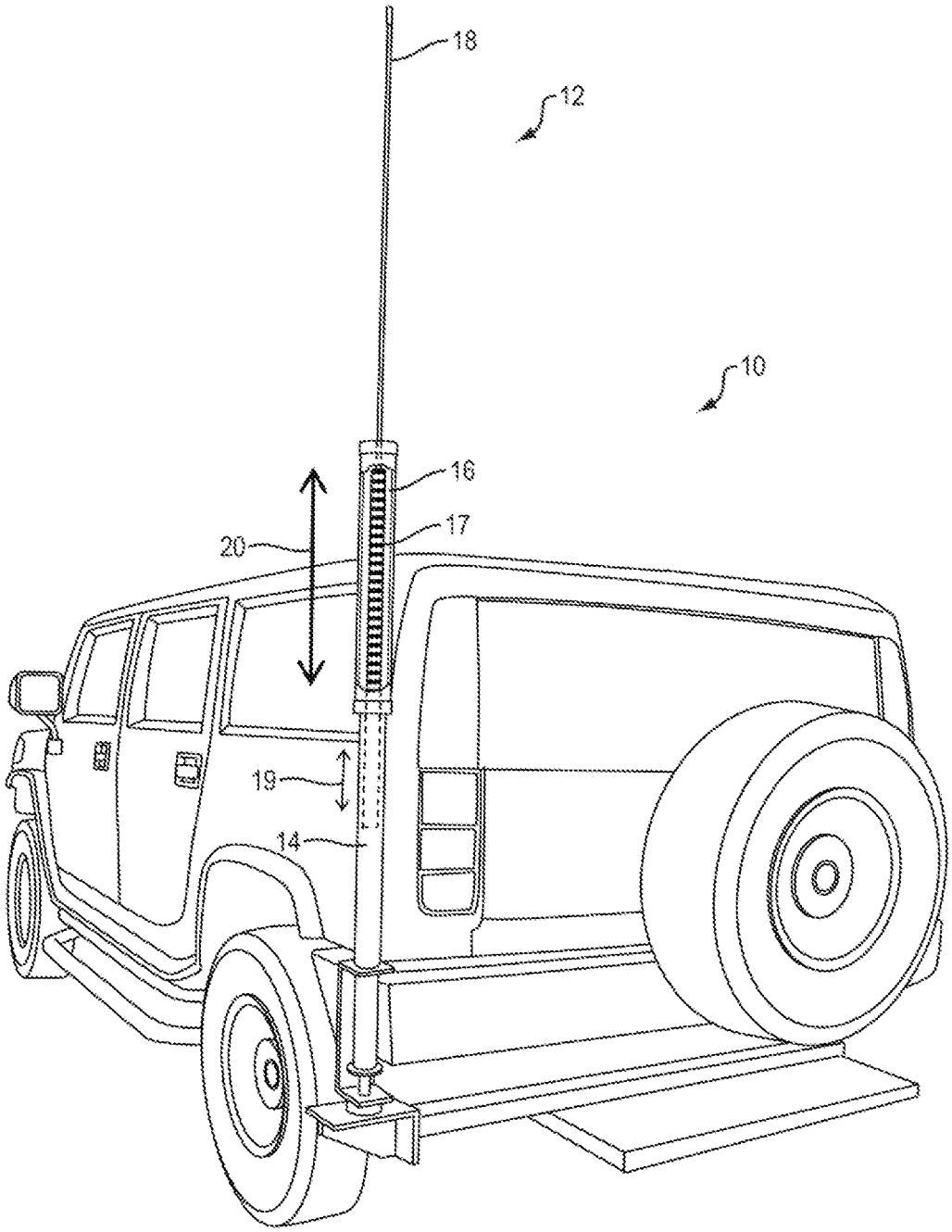
FIG. 1 (Prior Art)
FIG. 1 is a diagrammatic illustration of the utilization of an automatic screwdriver antenna attached to the bumper of a vehicle, illustrating that tuning of the antenna requires driving of the inner coil of the screwdriver antenna up and down until a suitable standing wave ratio is achieved.

Referring to FIG. 1, a vehicle 10 is provided with an automatic screwdriver antenna 12 which is composed of a stationary cylindrical housing 14 over which is mounted a translatable outer housing 16. Interior to housing 16 is a loading coil 17 attached at its top to housing 16 and to one end to a whip 18. Note that coil 17 translates as illustrated by double-ended arrow 19 within stationary cylindrical housing 14. Within cylindrical housing 14 is a shorting contact assembly which contacts coil 17 as it translates to short out various segments of the coil to establish tuning. Thus, the loading coil has turns which are shorted in accordance with the position of coil 17 and the shorting contact in stationary housing 14, such that when coil 17 translates as illustrated by double-ended arrow 20, the amount of interior coil shorted is controlled.

For a given length of antenna 12 and a given exterior configuration involving the vehicle 10 itself, a motor (not shown) drives coil 17 up-and-down until the standing wave ratio presented by the antenna 12 to the transceiver within the vehicle 10 is minimized. While this type of antenna 12 works satisfactorily and is relatively efficient, it sometimes takes as long as 3 minutes to be able to move the coil 17 up-and-down until the appropriate tap is made to the internally carried coil. Thus, changing frequency, and more especially when changing frequency bands, it takes a fair amount of time to be able to tune the mobile antenna 12 to a particular band and thence to a particular frequency within the band.

Moreover, the weight of such an antenna 12 is excessive and because of its size and wind resistance it is only mounted with difficulty on a vehicle 10. Additionally, the cost of such an efficient antenna 12 incorporates not only the cost of the coil 17 and sliding mechanism as well as its housings 14, 16, it also includes the cost of a drive motor and drive control circuitry as well as SWR monitoring. Importantly, automatic screwdriver antennas 12 are said to be unsightly and, for those wishing anonymity, it can hardly be said that such antennas 12 will be relatively unnoticeable.

Serially Connected Inductors

Rather than mounting the automatic screwdriver assemblage 12 depicted in FIG. 1 on a vehicle 10, the subject automatically tuned antenna includes a cylindrical housing 30 in which is housed serially connected coils 32 which, when selected, provide a selectable amount of inductance to be able to tune the whip antenna 34 to the output impedance of a transceiver 36 housed within vehicle 38. It will be appreciated that the physical size of housing 30 is considerably less than that associated with the automatic screwdriver antenna 12 of FIG. 1 and is considerably less costly and less unsightly. Moreover, wind resistance is kept to a minimum and because of its light weight, the entire package may be mounted not necessarily on the vehicle 38 bumper but may be mounted anywhere on the vehicle 38 such as with a window mount or a roof mount due to the fact that the entire package weighs less than 12 ounces, in one embodiment.

Most importantly, toroidal inductors are used to minimize interference with other coils, with the binary sequence coils connected in series to effectuate a perfect match for a given frequency band when, for instance, the relays that control the shorting of the coils are set when a sufficiently low standing wave ratio exists. The switching of the relays is almost instantaneous such that one can go from one frequency band to another almost instantaneously once the states of the relays for the band have been established. Moreover, control for the relays comes from a control head 40 within the body of vehicle 38, which is removed from the high current and voltage conditions at the mobile antenna. Removal of the control circuitry from the antenna is important because, in the past, RF fields from the antenna can affect electronic circuits located at an antenna. These RF fields can cause instability, and because the control head 40 is within the vehicle, which functions as a Faraday cage, the stability of the tuning of the antenna is not deleteriously affected by RF transmissions.

Also central to the stability of the mobile antenna is the use of toroidal inductors where needed. It is a feature of toroidal inductors that the RF fields are located solely within the torus and, thus, there is no crosstalk between the toroidal inductors. As a result, there is no necessity to calculate the interaction between inductors when designing the inductor circuit. Furthermore, the values of the inductors are binarily related such that if, for instance, the smallest inductor is 2 micro-henrys, the next larger inductor has a value of 4 microhenrys, with the next larger inductor having a value of 8 microhenrys. In short, the values of the inductance are multiplied by 2 for each step. Note also that the granularity of the tuning is determined by the inductor having the lowest inductance. Thus, when all the inductances are added together to create an acceptable standing wave ratio, the combination of inductances can be tailored in a cut-and-try operation to minimize the standing wave ratio.

Additionally, a shunt coil is connected between the antenna feed point and ground to match the impedance at the base of the antenna to the output impedance of the transmitter to which the antenna is connected.

Tuning of the subject antenna is quite easy. The easiest way to tune the antenna is to listen to a receiver coupled to the antenna and to turn the rotary tuning knob until one obtains maximum noise. In one embodiment, a knob push of the tuning knob increases tuning speed, such that the speed with which the relays are changed increases by a factor of 10 when the knob is depressed. Rotation of the knob results in adding or subtracting inductance with each rotary click of the knob. After coarse tuning is achieved, the knob is again pressed such that the tuning control goes to a slow mode. This permits one to transmit and observe the SWR until fine tuning of the inductance to the whip results in a low SWR.

Once a low SWR is achieved for a given band or a given frequency, in one embodiment, the relay states are set with the touch of a separate button, and a light emitting diode or LED will blink telling the operator that the state of the relays that resulted in the low SWR is stored temporarily in memory. Then, a second knob is turned to the band or frequency to be permanently stored with the related relay states. When the aforementioned LED goes out, the information is transferred from temporary memory to permanent memory at the band position indicated by the second knob. Thereafter, if one wishes to go to the particular frequency or band, one simply rotates the second knob to the position corresponding to that particular band or frequency, and the relays will be set in accordance with the previously memorized states.

As will be described, mobile antenna matching utilizing selectable series connected inductors is facilitated in a small package, which is both lightweight and inexpensive and which is mountable anywhere on a vehicle with a minimum amount of specialized mounting hardware. In one embodiment, the connector at the base of the inductor housing is a common threaded stud utilized in mounting a large variety of antennas to mobile mounts.

Figure 3:
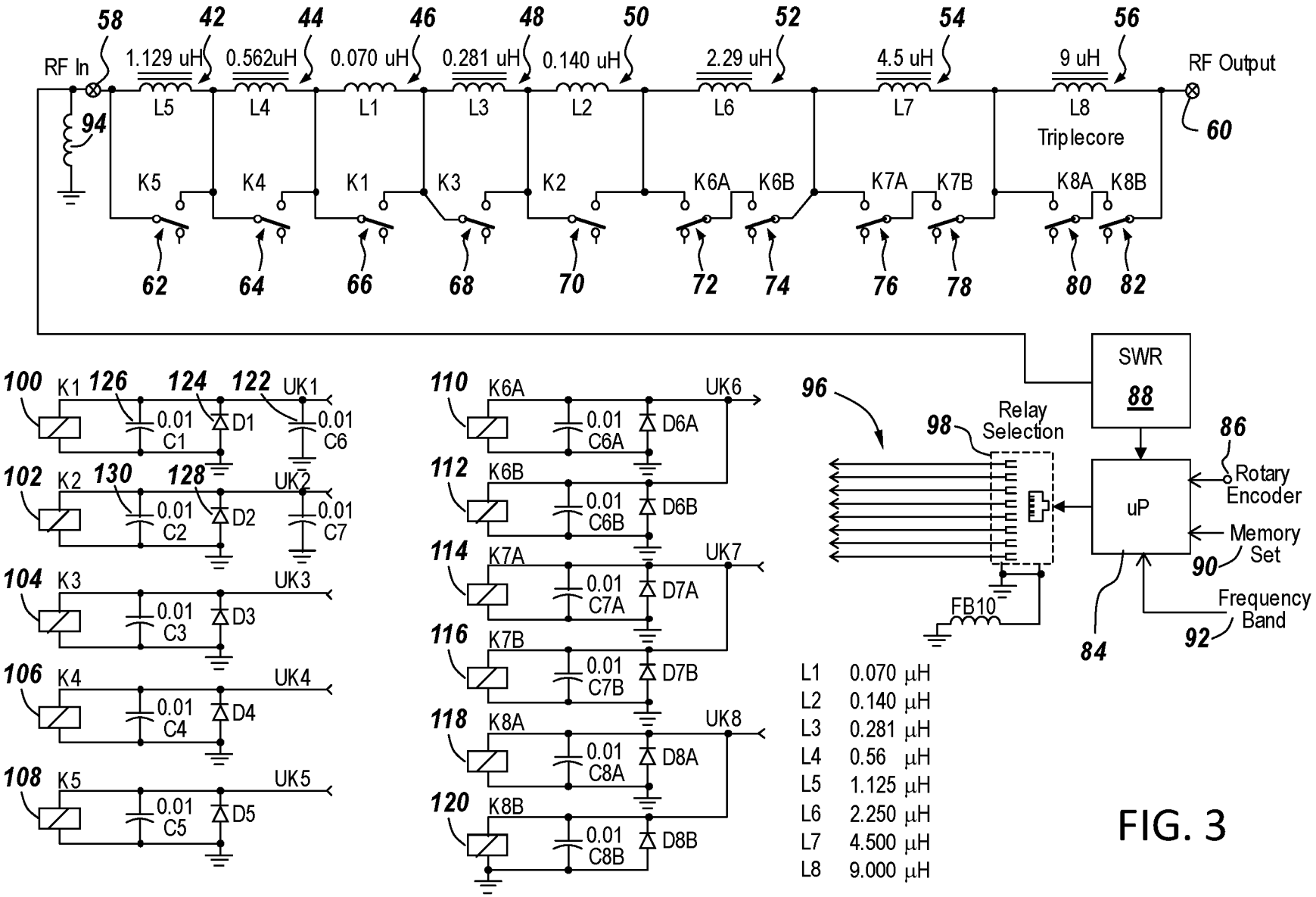
FIG. 3 is a schematic diagram of series-connected inductors connected between the antenna input and the RF output connected to a whip antenna which are selectively left open or shorted utilizing relays to selectively short selected coils for reducing the standing wave ratio to an acceptable level, with relay selection being under the control of a microprocessor coupled to a rotary encoder switch to initially set the relays until an appropriate SWR match is achieved, also showing that upon achieving of a suitable SWR for a given frequency or frequency band, the relay states are memorized along with the frequency or frequency band, with the relay states recallable when the operator of the transmitter wishes to operate on the memorized frequency or frequency band.

Referring now to FIG. 3, in one embodiment, a number of series-connected inductors 42, 44, 46, 48, 50, 52, 54, and 56 are serially connected between an input antenna terminal 58 and an output terminal 60 to which a mobile antenna, normally a whip, is mounted. The whip presents an impedance which is generally quite high due to its short length for mobile applications, and the series connected loading coils are interposed between the antenna feed point and the base of the whip to bring down the associated impedance to that which matches the output impedance of the transmitter to which the antenna is coupled. In one embodiment, a series of relays 62, 64, 66, 68, 70, 72, 74, 76, 78, 80, and 82 are shown initially shorting out the associated coils. In order to match the impedance of the shortened antenna to the transmitter output impedance, a microprocessor 84 controls the position of the switches to short associated coils. In one embodiment, antenna matching is accomplished on a cut-and-try ad hoc basis utilizing a digital rotary encoder switch 86, decoded by microprocessor 84, which selectively shorts various of the associated coils. During this process, the standing wave ratio is measured by SWR meter 88 to indicate when in the rotation of the digital rotary encoder switch 86 a minimum SWR has been achieved. When a minimum SWR has been achieved, memory within microprocessor 84 is set as illustrated at 90, which memorizes the relay states as well as the frequency band 92 of the RF driving the antenna.

Having memorized the frequency or frequency band and the switch states, one can return the relays to the required states for the desired frequency or frequency band.

It is noted that a shunt coil 94 is utilized to match the tuned antenna to the transmitter output impedance, as is common with screwdriver antennas. Note that there is no specialized impedance transformer at the base of this antenna, with the inductors and the shunt coil 94 providing all of the necessary inductance values for the matching.

In this embodiment, there are a number of toroids, which are controlled over a multiline cable 96 connected by connector 98 to microprocessor 84. As illustrated, these lines connect to relay actuators 100, 102, 104, 106, 108, 110, 112, 114, 116, 118, and 120. These drive circuits are isolated from any RF fields due to the capacitor and diode networks coupled to the input to these actuators, as illustrated by capacitor 122, diode 124, and capacitor 126 for actuator 100 and additionally diode 128 and capacitor 130 for actuator 102. While in some cases it is only necessary to provide one relay to short an inductor, in some instances, the voltages at the inductor are relatively large, necessitating series-connected relays. Relays of a common variety can handle 1,000 volts. However, when serially connected, they can handle twice the voltage. Thus, it is not necessary in the high-RF environment of the mobile antenna to utilize exotic reed switches, which are both bulky and expensive, but rather one can utilize standard inexpensive relays, connected in series, to be able to withstand the high voltages at various points in the circuit. Here, the double relay configuration is utilized to short toroidal inductor 52, toroidal inductor 54, and toroidal inductor 56.

Figure 2:
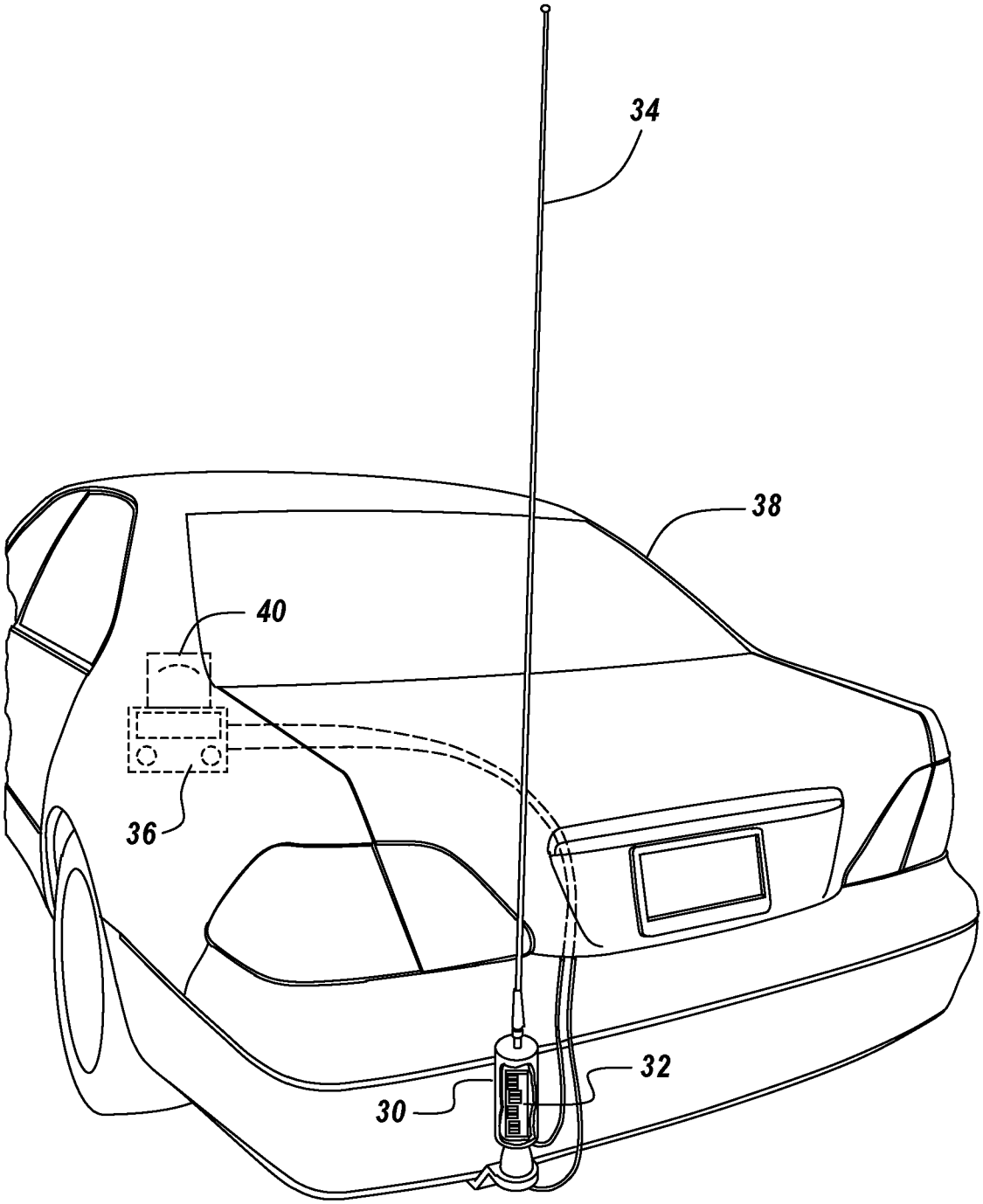
FIG. 2 is a diagrammatic and cut away illustration of an automatically tunable mobile antenna mounted to the rear bumper of a vehicle in which binary series-related inductors are series connected and located within an inductor housing having an RF input at the bottom and a whip mounted on top of the inductor housing, with control of the switching of the inductors in and out of the circuit controlled by a control head internal to the body of the vehicle.
Figure 4:
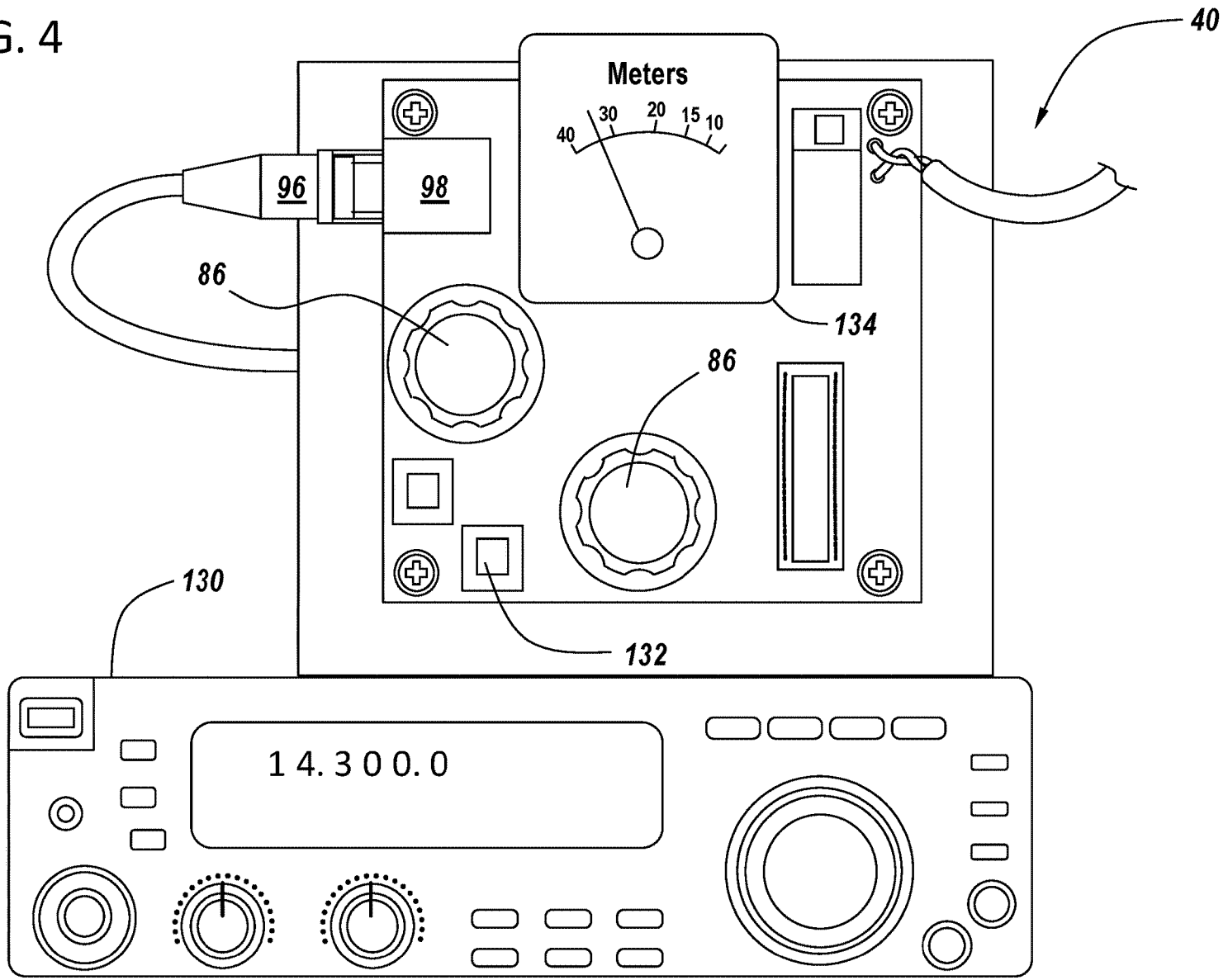
FIG. 4 is a diagrammatic illustration of the control head mounted within the vehicle for use in initially setting relay states to achieve a minimum SWR and for thereafter recalling the relay states for a given frequency or frequency band.

Referring now to FIG. 4, when the mobile antenna of FIG. 2 is driven by a transceiver 130, for instance, set to 14.300 MHz, control head 40, in one embodiment, includes rotary encoder switch 86, which is utilized to set the switch states of the relays of FIG. 3. A button 132 is utilized to memorize the switch states of the relays when the standing rave ratio set by the relays is at an acceptable level. This may be determined by an SWR meter on the transceiver itself or by a separate SWR meter on the control head 40. As mentioned before, the frequency or frequency band is memorized at microprocessor 84. When wishing to return to a given frequency or frequency band, a rotary frequency band switch 86 is utilized to read out the memory corresponding to the frequency band and return the relays to the switch states associated with the frequency in the frequency band. The frequency band selected by switch 86 may be indicated on meter 134 so as to give the radio operator an indication of the frequency band to which the antenna is being tuned.

Further, rotary frequency band switch 86 may be replaced by multiple push-button switches. In accordance with some embodiments, control head 40 may include an indicator configured to indicate when antenna 34 is radiating power. For instance, the indicator may be a SWR meter connected in series with the coaxial cable coming from the transmitter or a field strength meter to indicate relative radiated power.

Figure 5:
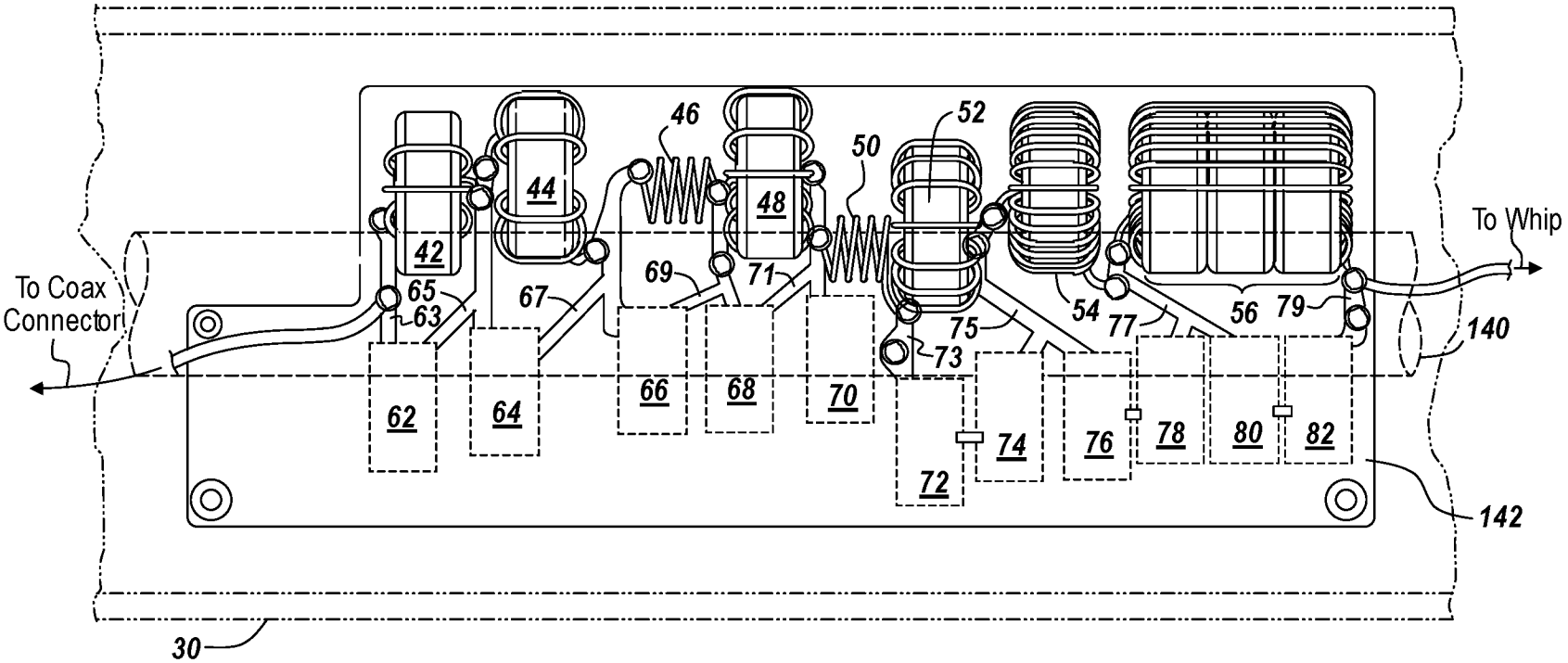
FIG. 5 is a diagrammatic illustration and top view of the mounting of eight inductors on a circuit board, the majority being toroidal to minimize crosstalk, mounted to a central nonconductive support shaft within the inductor housing, also showing the location of relays to control the amount of inductance added between the RF input to the antenna and the whip.

Referring now to FIG. 5, the mechanical construction of housing 30 is illustrated. Here, a cylindrical housing 30 houses a central vertically upstanding nonconductive rod 140, which is attached to a threaded stud (not shown) and a top whip connector (not shown). Affixed to this central rod 140 is a circuit board 142 on which are mounted coils 42, 44, 46, 48, 50, 52, 54, and 56. The shorted or open state of each of these coils is controlled by relays 62, 64, 66, 68, 70, 72, 74, 76, 78, 80, and 82.

In operation, relay 62 is connected to short coil 42 utilizing circuit board traces 63 and 65, whereas relay 64 shorts out coil 44 utilizing traces 65 and 67. Relay 66 shorts out coil 46 utilizing traces 67 and 69, and relay 68 shorts out coil 48 utilizing traces 69 and 71. Relay 70 shorts out coil 50 utilizing trace 71 and trace 73. Relays 72 and 74 are serially connected together such that in series they short coil 52 utilizing traces 73 and 75. Relays 76 and 78 are serially connected together and short out coil 54 utilizing traces 75 and 77, whereas relays 80 and 82 are serially connected together and are used to short out coil 56 utilizing traces 77 and 79. The relays can be any relays capable of handling the required voltage and current and can be single relays not in series.

It will be noted that coils 46 and 50 are preferably air wound, whereas the remainder of the coils 42, 44, 48, 52, 54, and 56 are toroidal coils used to prevent interference and crosstalk. The air wound coils 46 and 50 are located sufficiently far apart to eliminate crosstalk and are used for their low inductance values and because they are much more efficient. However, the majority of the coils are toroidal coils, used to eliminate crosstalk, keep the coil sizes small, and increase the stability of antenna operation. Also, mounted outside the inductor housing is shunt coil 94, as illustrated. It will be appreciated that all of the coils 42, 44, 46, 48, 50, 52, 54, and 56, both toroidal or air wound, as well as the relays 62, 64, 66, 68, 70, 72, 74, 76, 78, 80, and 82, are housed within housing 30 and are mounted to the aforementioned central shaft 140.

In one embodiment, the inductances of the 8 coils 42, 44, 46, 48, 50, 52, 54, and 56 are given by the following table:

TABLE I

| | |
|---|---|
| L1 | 0.070 μH |
| L2 | 0.140 μH |
| L3 | 0.281 μH |
| L4 | 0.562 μH |
| L5 | 1.125 μH |
| L6 | 2.25 μH |
| L7 | 4.5 μH |
| L8 | 9 μH |

Note that the order of the mounting of the coils 42, 44, 46, 48, 50, 52, 54, and 56 on the circuit board 142 does not necessarily reflect the binary series of inductance values, and their location is dictated by non-interference considerations and mechanical mounting convenience.

Figure 6:
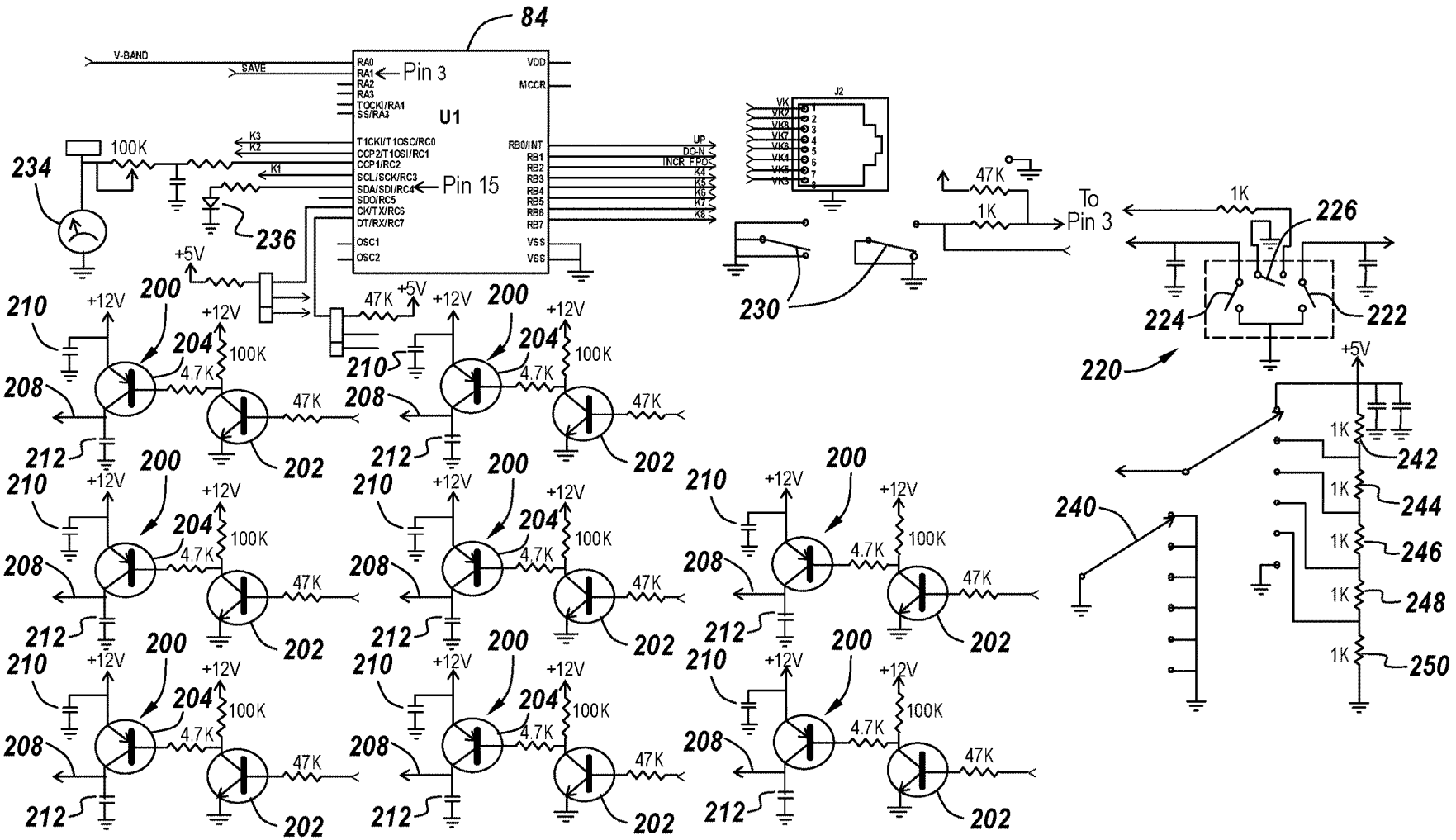
FIG. 6 is a detailed schematic diagram showing the switching circuits utilized in the control of the relays illustrated in FIGS. 3 and 5.

Referring to FIG. 6, a detailed schematic diagram illustrates the transistorized switching circuits utilized to control the aforementioned relays 62, 64, 66, 68, 70, 72, 74, 76, 78, 80, and 82, as well as a mechanical rotary switch 220 utilized to initially manually set the relays 62, 64, 66, 68, 70, 72, 74, 76, 78, 80, and 82. Also shown is a meter utilized in indicating the frequency band to which the autotune antenna is set.

In this figure, microprocessor 84 is utilized to actuate relay drive circuits 200, each of which are composed of a sense transistor 202 connected to the base of a high-power switching transistor 204 such that upon application of a drive signal over line 208 to the base of transistor 202, current through this transistor 202 brings down the voltage at the base of transistor 204 to turn transistor 204 on. The emitter of transistor 204 is connected to the B+, in one embodiment, 12 V, such that when transistor 204 is turned on, this voltage is applied from the collector of transistor 204 to the associated relay drive as illustrated at 208. Note that a capacitor 210 runs from B+ to ground, whereas a capacitor 212 runs from the collector of transistor 204 to ground for filtering out stray RF.

It will be noted that pin 14 of microprocessor 84 provides a voltage to the base of transistor 202, with pins 11 and 12 controlling the bases of the transistors corresponding to relays K2 and K3. Control for the bases of transistors labeled K4-K9 are available from output pins 24-28 of microprocessor 84 to control the associated relays.

It will be appreciated that microprocessor 84 is utilized to actuate the relays associated with inductors L1-L8 under the control of a rotary switch generally indicated at 220. With each rotation of the rotary digital encoder switch 220, for instance, clockwise, switch 222 is closed, and microprocessor 84 is utilized to sequentially actuate the associated relays in an up direction, whereas when rotary digital encoder switch 220 is rotated, for instance, counterclockwise, switch 224 is closed, and the relays are actuated in the down direction. The direction which the microprocessor 84 is instructed to go in the sequencing of the relay states is dependent upon the clockwise or counterclockwise rotation of the rotary digital encoder switch 220. The speed by which the microprocessor 84 moves upwardly or downwardly through the relay states can be increased by the closing of switch 226 such that when the switch 226 is closed as, for instance, by the depression of a button on the front panel of the controller, the relay states are rapidly cycled, whereas when the switch 226 is not depressed, the relay states are changed in a relatively slow fashion.

As mentioned before, when the standing wave ratio is indicated as being within an acceptable range, the relay states are stored in the microprocessor 84 in accordance with the memory set by a second rotary switch 240, which establishes the band of interest. With the depression of a switch here illustrated at 230, the switch states of the relays for the selected band of interest are memorized, with the depression of switch 230 resulting in a signal being applied to input pin 3 of microprocessor 84 to save the particular relay states in the designated band memory when switch 230 is closed.

In one embodiment, the band of the saved relay states is indicated by analog meter 234 so that the particular band being tuned is readily observable by the radio operator. Additionally, an LED 236 is actuated when the save button is pressed which is activated by a signal at terminal 15 to indicate that a particular relay state has been saved in a designated band.

In operation, the frequency band associated with the rotary encoder band switch is decoded by the associated switch position of switch 240, which taps a particular voltage from a resistor string composed of resistors 242, 244, 246, 248, and 250, with the resistors having the resistance values illustrated. These resistor values correspond to 6 memory locations corresponding to 6 bands. This type of rotary band encoder decoding system requires only one lead from switch 240 to the microprocessor 84, with the voltage on the lead determining which band is being tuned. Thus, the rotary switch band encoder positions are converted into voltages to define a frequency band that relates to corresponding relay states. While there are only 6 positions illustrated, the number can be doubled so as to accommodate additional memory locations corresponding to more frequency bands.

Having selected the particular band for which the antenna is to be tuned, rotation of digital rotary encoder switch 220 provides for changing of relay states until such time as a suitable standing wave ratio is achieved. When this standing wave ratio has been achieved, pressing of switch 230 results in the saving of the relay switch states into the band designated by rotary encoder switch 240.

It will be appreciated that with 8 possibilities for the switching states associated with the operation of digital rotary encoder switch 220, the amount of inductance inserted between the antenna feed point and the antenna whip has $2^8$ (or 256) possible values, with the smallest increment being that associated with the smallest value of inductance for a coil, in this case 0.070 μH. This gives a sufficient inductance range for a wide variety of operating conditions for whips, for instance, between 5 and 10 feet in length, with the fine-tuning granularity being provided by the coil having the least inductance. When more inductance may be required, for instance, for extending the operation from 40 m to 80 m, additional coils may be added in series.

Variable Toroidal Inductor

In accordance with some embodiments, instead of (or in addition to) utilizing an approach employing a series of connected inductors (as discussed above), a variable toroidal inductor assembly 700 may be utilized. As will be appreciated in light of this disclosure, one or more of the same capabilities, elements, and configurations discussed above, for example, with respect to coils 32 and related system componentry may be utilized here, too, in the context of assembly 700, in accordance with some embodiments.

Figure 7:
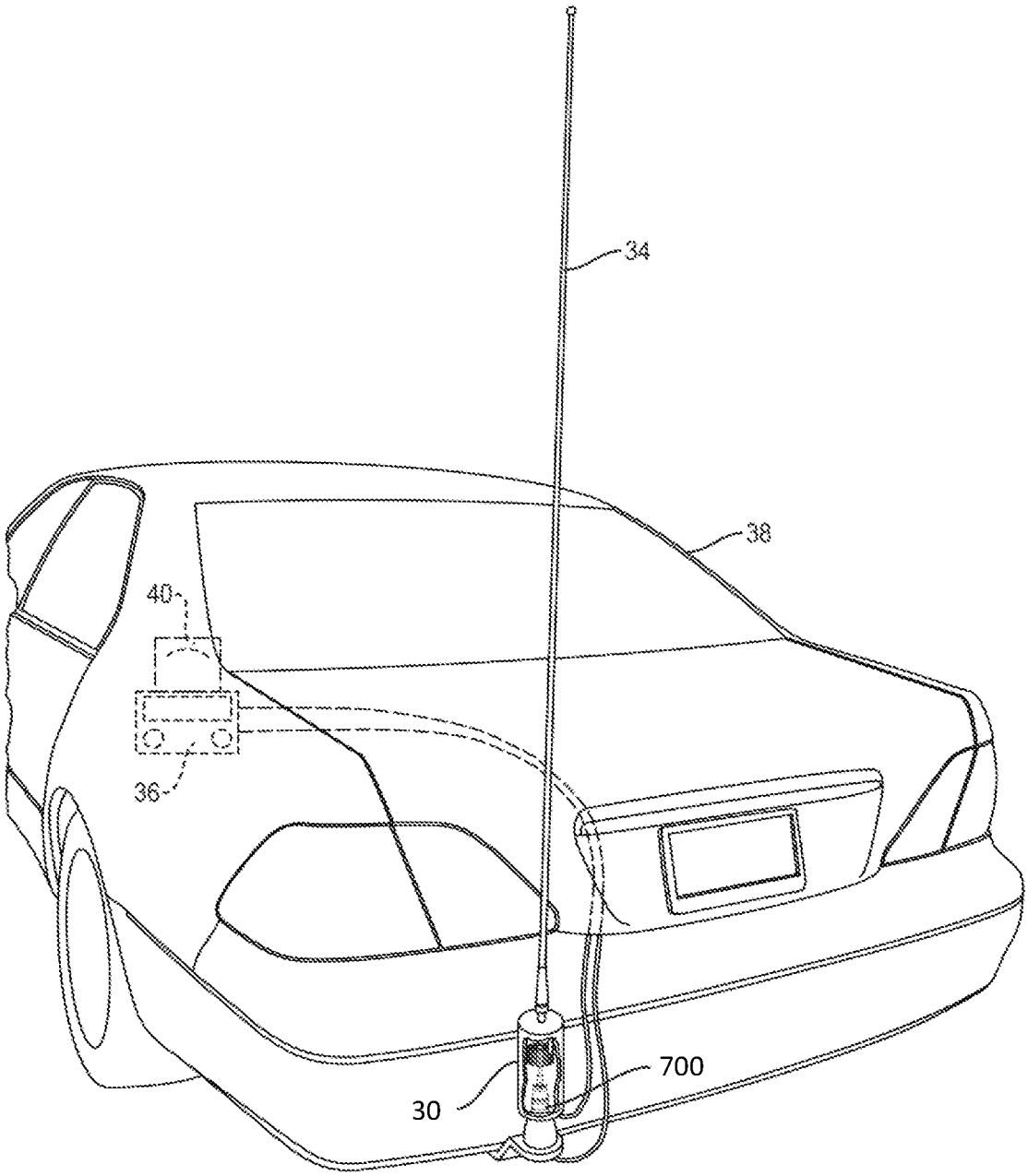
FIG. 7 is a diagrammatic and cut away illustration of an automatically tunable mobile antenna mounted to the rear bumper of a vehicle in which a variable toroidal inductor assembly is located within a housing having an RF input at the bottom and a whip mounted on top of the housing, with control provided by a control head internal to the body of the vehicle in accordance with an embodiment of the present disclosure.

FIG. 7 is a diagrammatic and cut away illustration of an automatically tunable mobile antenna mounted to the rear bumper of a vehicle 38 in which a variable toroidal inductor assembly 700 is located within a housing 30 having an RF input at the bottom and a whip 34 mounted on top of the housing 30 in accordance with an embodiment of the present disclosure. Assembly 700 may be configured, in accordance with some embodiments, to be utilized with any antenna (mobile or otherwise) that may require or otherwise benefit from involving a variable inductor element. As will be appreciated in light of this disclosure, assembly 700 may be configured, in accordance with some embodiments, for use in fixed station applications and marine antenna applications, among others. In some cases, assembly 700 may be configured for use as a loading coil for an antenna.

Figure 8:
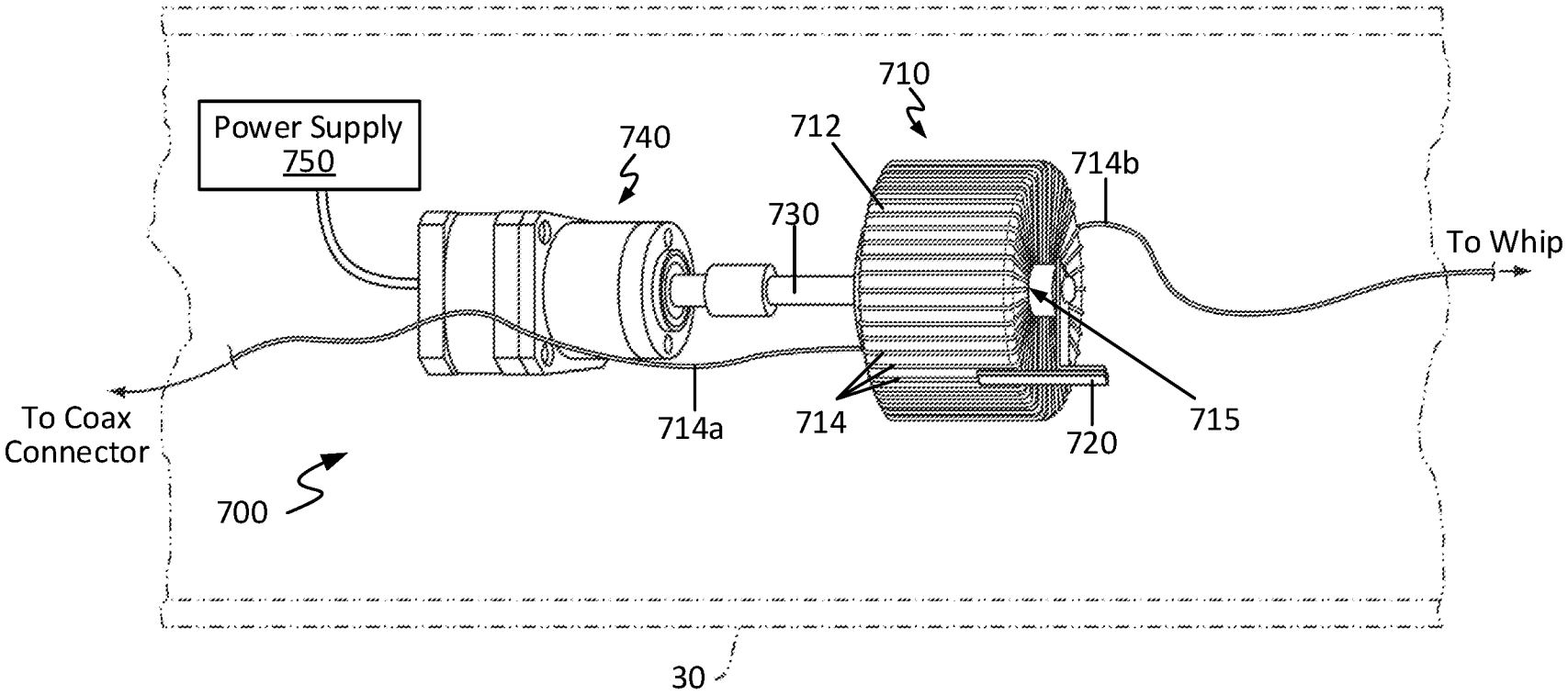
FIG. 8 is a diagrammatic illustration of a variable toroidal inductor assembly disposed within a housing in accordance with an embodiment of the present disclosure.
Figure 9:
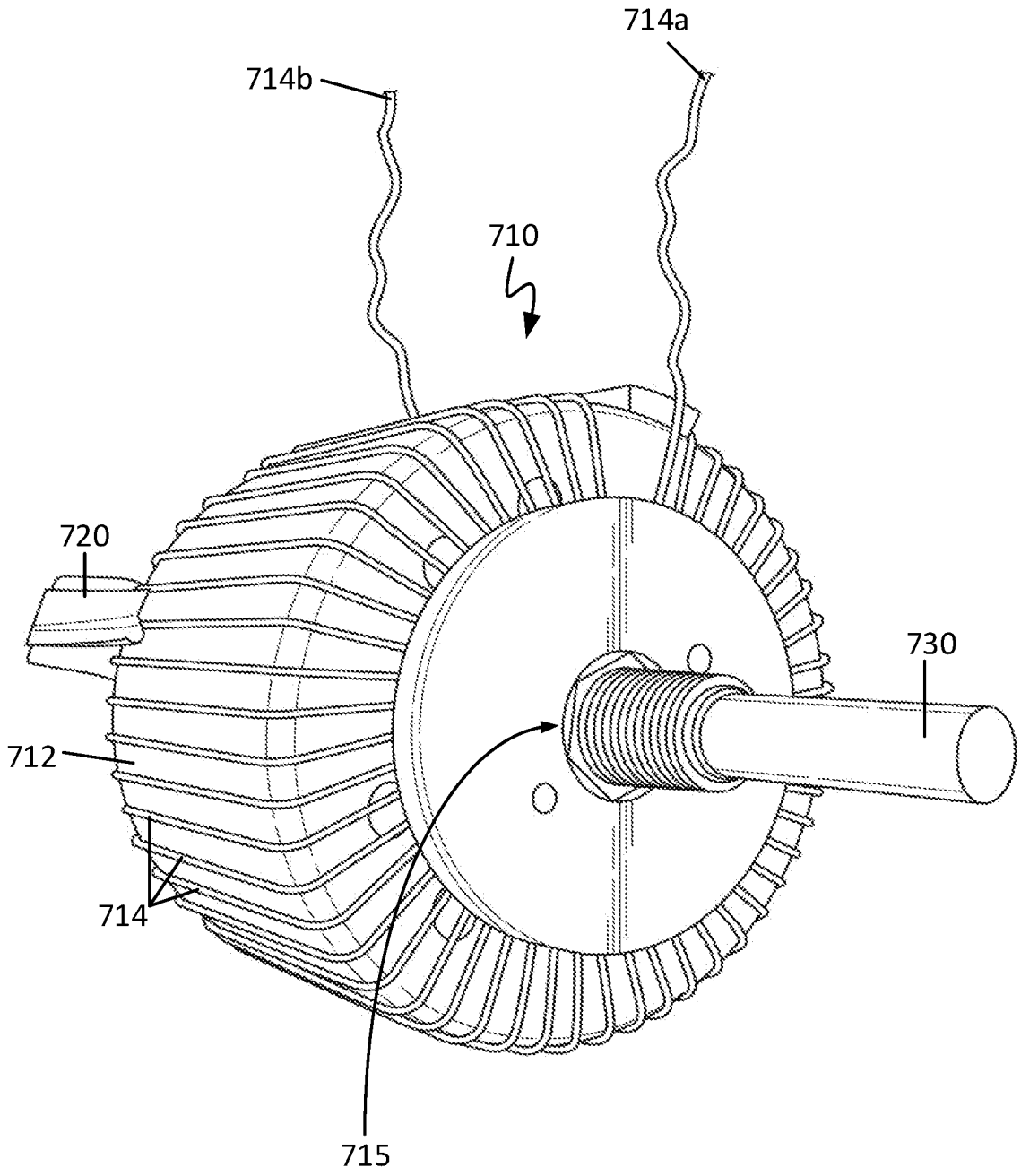
FIG. 9 is a view of a toroidal inductor with a movable contact arm and shaft configured in accordance with an embodiment of the present disclosure.

FIG. 8 is a diagrammatic illustration of a variable toroidal inductor assembly 700 disposed within a housing 30 in accordance with an embodiment of the present disclosure. FIG. 9 is a view of a toroidal inductor 710 with a movable contact arm 720 and shaft 730 configured in accordance with an embodiment of the present disclosure. As can be seen, variable toroidal inductor assembly 700 may include a toroidal inductor 710. In accordance with some embodiments, toroidal inductor 710 may include a core 712 and a plurality of windings of wire 714 wound around that core 712. In some embodiments, core 712 may be generally ring-shaped (annular; donut-shaped), having a hollow center region 715. In some embodiments, core 712 may be of generally circular or elliptical cross-sectional geometry. In some other embodiments, core 712 may be of generally rectangular (e.g., square) cross-sectional geometry. The dimensions of core 712 may be customized, as desired for a given target application or end-use.

Additionally, the material composition of core 712 may be selected, as desired, to increase or decrease the total maximum inductance possible for toroidal inductor 710. In some embodiments, core 712 may be, in part or in whole, an air core or core made from an insulator material. In some other embodiments, core 712 may be made, in part or in whole, from powder-iron, ferrite, or brass, among others. As will be appreciated in light of this disclosure, provision of an air core 712 may provide, at least in some cases, for a relatively small inductance change in operation of assembly 700 (e.g., with each turn of movable contact arm 720 in shorting out windings of wire 714, as discussed below). As will be further appreciated, an air core 712 may be more resistant to saturation, unlike some other materials, if excess power is applied to toroidal coil 710.

Regarding wire 714, the length and gauge thereof may be customized, as desired for a given target application or end-use. Moreover, the quantity and pitch/spacing of windings of wire 714 may be customized, as desired. Furthermore, the material composition of wire 714 may be selected, as desired, and in at least some embodiments may be an electrically conductive metal such as, for example, copper (Cu), aluminum (Al), or silver (Ag), to name a few. As generally can be seen in FIG. 8, for example, a first end 714*a* of wire 714 may be configured to be connected to a coax connector, and a second end 714*b* of wire 714 may be configured to be connected to an antenna, in accordance with some embodiments.

As can be seen further from FIGS. 8-9, assembly 700 also may include a movable contact arm 720 connected to an end of a shaft 730, in accordance with some embodiments. Shaft 730 may be configured, in accordance with some embodiments, to be inserted through and rotated within center region 715 of toroidal inductor 710. Thus, in accordance with some embodiments, rotation of shaft 730 within center region 715 may result in rotation of movable contact arm 720 relative to the windings of wire 714 of toroidal inductor 710. In this manner, movable contact arm 720 may be rotated to change its contact (physical and/or electrical) with a given turn of wire 714, thereby electrically shorting out one or more windings of wire 714 from the RF input side of toroidal inductor 710 and so varying the inductance of toroidal inductor 710. Thus, in a more general sense, movable contact arm 720 may be configured as a movable (e.g., sliding) electrical tap configured to short turns of wire 714, changing the overall inductance provided by toroidal inductor 710, in accordance with some embodiments.

To such ends, the particular configuration, including dimensions and shape, of movable contact arm 720 may be customized, as desired for a given target application or end-use. In an example embodiment, movable contact arm 720 may include a first portion extending radially outward from center region 715, which first portion transitions to a second portion extending longitudinally (e.g., generally parallel to a rotation axis of shaft 730) along an exterior of toroidal inductor 710. In an example embodiment, the second portion of movable contact arm 720 may be generally perpendicular to the first portion thereof. In an example embodiment, the first and second portions may be separate pieces that have been assembled together (e.g., a polylithic body) in forming movable contact arm 720. In another example embodiment, the first and second portions may be formed integrally, as a single piece (e.g., a monolithic body). Furthermore, the material composition of movable contact arm 720 may be selected, as desired, and in at least some embodiments may be an electrically conductive metal.

In accordance with some embodiments, assembly 700 optionally may have an indicator operatively connected thereto to indicate the position of movable contact arm 720 relative to the windings of wire 714 of toroidal inductor 710. For instance, in an example case, shaft 730 may include an indicator, such as a dial, operatively connected thereto at an end opposite movable contact arm 720. Regardless of its particular form, at least in some instances, the inductance of toroidal inductor 710 may be readily discerned by considering the indicator if optionally included.

As previously noted, shaft 730 may be configured, in accordance with some embodiments, to be rotated within center region 715 of toroidal inductor 710. To that end, shaft 730 may be configured to be rotated either (or both) manually (e.g., by hand by a user) and automatically (e.g., mechanically by a motor 740 operatively connected to shaft 730), in accordance with some embodiments. In some cases, shaft 730 may be rotated manually utilizing a knob or a flexible shaft connected thereto. In some cases, assembly 700 optionally may include a motor 740, which may be configured to be connected with shaft 730. As will be appreciated in light of this disclosure, motor 740 may have any of wide range of configurations. For instance, in accordance with some embodiments, motor 740 may be any one (or combination) of a stepper motor, a DC motor, a gear-reduced DC or AC motor with a position feedback potentiometer, and a servo motor. Motor 740 may be configured, in accordance with some embodiments, to be connected to a power supply 750 configured to provide a given amount of power to motor 740 to rotate shaft 730. In accordance with some embodiments, power supply 750 may be, for instance, a power source native to a host vehicle 38. In some embodiments, power supply 750 may be a battery, which may be permanent or replaceable.

In accordance with some embodiments, control of the selective shorting of inductor windings 714 into and out of the antenna tuning circuit may be provided, in part or in whole, by a control unit (e.g., such as a control head 40 internal to the body of a host vehicle 38). Motor 740 or, more generally, assembly 700 may be communicatively coupled with the control unit. In some embodiments, the control unit may be a mechanical and/or electronic device configured to count the quantity of turns of motor 740 to indicate the position of movable contact arm 720 and, thus, determine the inductance provided by toroidal inductor 710. In some embodiments, the control unit may be (or otherwise may include) a switch configured to toggle between clockwise and counterclockwise rotation of shaft 730 (and thus movable contact arm 720) by motor 740. As will be appreciated in light of this disclosure, the fineness or coarseness of control over rotation of shaft 730 using motor 740 may be customized, as desired for a given target application or end-use.

Figure 10:
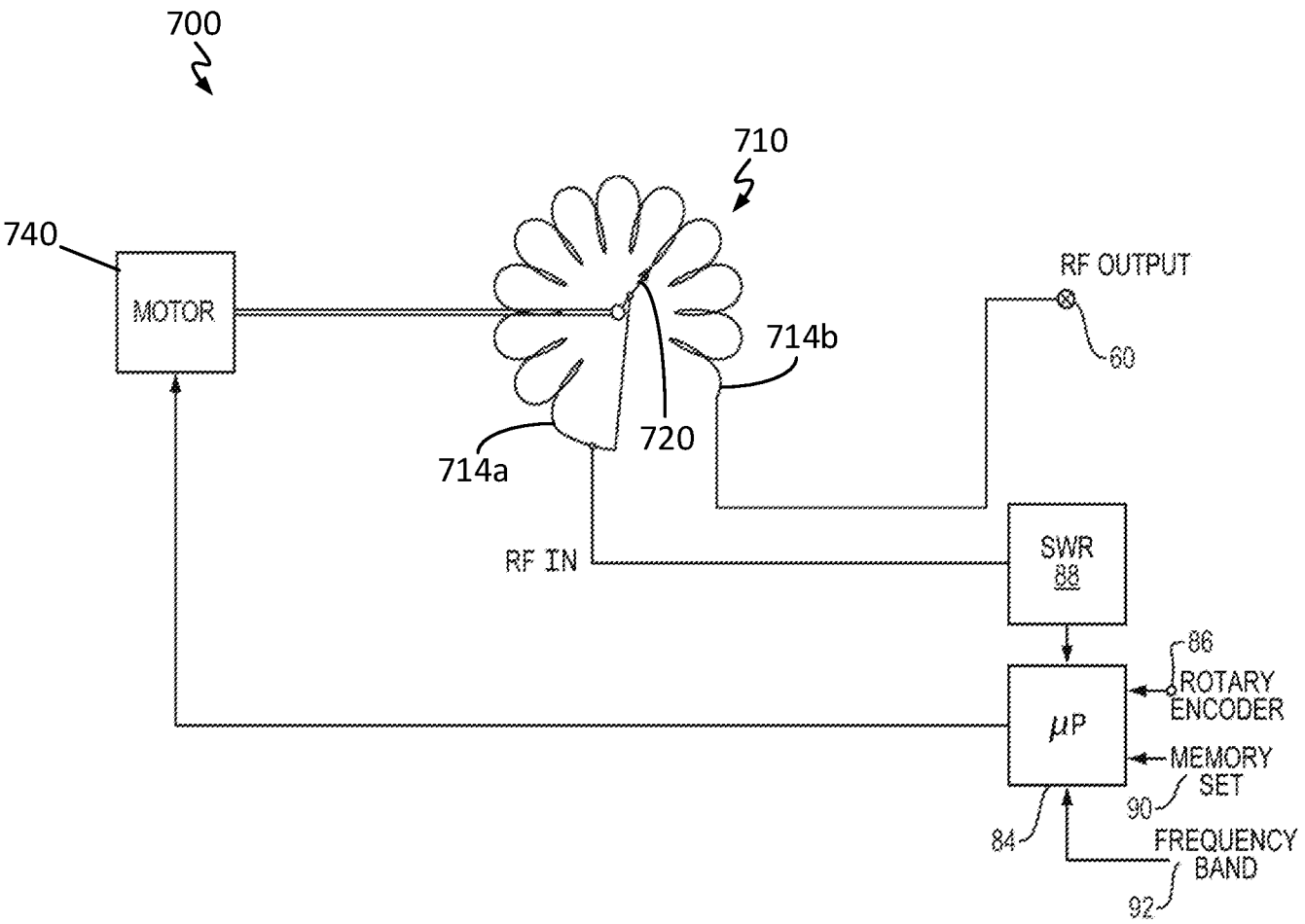
FIG. 10 is a schematic diagram of a variable toroidal inductor assembly connected between the antenna input and the RF output connected to a whip antenna in accordance with an embodiment of the present disclosure.

FIG. 10 is a schematic diagram of a variable toroidal inductor assembly 700 connected between the antenna input and the RF output 60 connected to a whip antenna, in accordance with an embodiment of the present disclosure. As discussed above, movable contact arm 720 may be rotated by shaft 730 so as to contact and, thus, selectively electrically short out one or more windings of wire 714 of toroidal inductor 710, thereby selectively changing the inductance of toroidal inductor 710 and, thus, adjusting SWR to a given target level, in accordance with some embodiments. In some instances, it may be desirable to minimize or otherwise reduce SWR as much as possible utilizing toroidal inductor 710 (or assembly 700 more generally). In at least some cases, each turn of movable contact arm 720 may yield a generally small variation in inductance for toroidal inductor 710. As can be seen in FIG. 10, in at least some cases, toroidal inductor 710 may be driven by SWR sensor 88 and microprocessor 84 with inputs 86, 90, 92, as previously discussed herein. As can be seen further in FIG. 10, in at least some cases, winding shorting may be at least partially under the control of a microprocessor 84 coupled to a rotary encoder switch 86 to initially set the inductance until a target SWR is achieved. In accordance with some embodiments, upon achieving a suitable SWR for a given frequency or frequency band, the state for shorting winding(s) may be memorized along with the frequency or frequency band, with the state recallable when a user of the transmitter wishes to operate on the memorized frequency or frequency band.

As will be further appreciated in light of this disclosure, the total amount of inductance that may be provided by toroidal inductor 710 may depend on a number of factors, including parameters stemming from the particular configuration of that toroidal inductor 710. If additional inductance beyond the maximum that can be provided by toroidal inductor 710 is desired, one or more fixed series inductance elements optionally may be included to be switched into and out of the overall tuning circuit, as desired, in accordance with some embodiments.

While the present invention has been described in connection with the preferred embodiments of the various figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended Claims.

What is claimed is:

1. An antenna tuning device configured to be connected between a radio frequency (RF) signal source and an antenna, the antenna tuning device comprising:

a toroidal inductor comprising a plurality of windings of electrically conductive wire;

a shaft extending through a center region of the toroidal inductor and configured to rotate within the center region of the toroidal inductor; and a movable contact arm connected to an end of the shaft, wherein by rotating the shaft within the center region of the toroidal inductor, the movable contact arm rotates so as to selectively electrically short at least one of the windings of wire contacted by the movable contact arm, thereby changing an inductance of the toroidal inductor.

2. The antenna tuning device of claim 1, wherein the toroidal inductor comprises an air core.

3. The antenna tuning device of claim 1, wherein the toroidal inductor comprises at least one of a powder-iron core, a ferrite core, and a brass core.

4. The antenna tuning device of claim 1, wherein the toroidal inductor is of generally circular or elliptical cross-sectional geometry.

5. The antenna tuning device of claim 1, wherein the toroidal inductor is of generally rectangular or square cross-sectional geometry.

6. The antenna tuning device of claim 1, wherein the electrically conductive wire comprises at least one of copper (Cu), aluminum (Al), and silver (Ag).

7. The antenna tuning device of claim 1, wherein the movable contact arm is configured to contact only a single winding of wire at a time.

8. The antenna tuning device of claim 1, wherein the movable contact arm is configured to contact a plurality of windings of wire at a time.

9. The antenna tuning device of claim 1, wherein the movable contact arm is an assembly of at least two bodies.

10. The antenna tuning device of claim 1, wherein the movable contact arm is of single-piece construction.

11. The antenna tuning device of claim 1, wherein the shaft is configured to be rotated manually.

12. The antenna tuning device of claim 1, wherein the shaft is configured to be rotated mechanically.

13. The antenna tuning device of claim 1, wherein the shaft is configured to be rotated both manually and mechanically.

14. The antenna tuning device of claim 1, further comprising a motor connected to the shaft and configured to rotate the shaft within the center region of the toroidal inductor.

15. The antenna tuning device of claim 14, wherein the motor comprises at least one of a stepper motor, a DC motor, a gear-reduced motor with a position feedback potentiometer, and a servo motor.

16. The antenna tuning device of claim 14, further comprising a power supply configured to provide power to the motor in rotating the shaft.

17. The antenna tuning device of claim 14, further comprising a controller configured to control the motor in rotating the shaft.

18. The antenna tuning device of claim 1, wherein the RF signal source is a transmitter.

19. The antenna tuning device of claim 1, wherein the antenna is a whip antenna.

20. An antenna tuning module comprising:

the antenna tuning device of claim 1; and a housing configured to at least partially house the antenna tuning device.

* * * * *